United States Patent [19]

Cartabbia

[11] Patent Number: 4,756,103

[45] Date of Patent: Jul. 12, 1988

[54] MACHINE FOR PRESSING OPEN SEAMS

[76] Inventor: Giovanni Cartabbia, Via Fusline, 36, 25036 Palazzolo Sull-Oglio (Brescia), Italy

[21] Appl. No.: 25,729

[22] Filed: Mar. 13, 1987

[30] Foreign Application Priority Data

Mar. 21, 1986 [IT] Italy ..... 19822 A/86

[51] Int. Cl.[4] ..... D06F 69/00

[52] U.S. Cl. ..... 38/1 B; 38/17; 112/217

[58] Field of Search ..... 38/1 B, 17, 19, 20; 223/37; 112/147, 217

[56] References Cited

U.S. PATENT DOCUMENTS 3,913,248 10/1975 Thompson ..... 38/1 B 4,495,879 1/1985 Yamamoto ..... 38/1 B X

*Primary Examiner*—Louis K. Rimrodt

*Assistant Examiner*—Judith L. Olds

*Attorney, Agent, or Firm*—Bucknam and Archer

[57] ABSTRACT

A machine for folding and pressing the internal flaps of seams comprises a heated plate 1 in the body of which are fomed separate chambers 6, 7, 8 respectively connected to a steam generator, a suction system and a cold air blower. These chambers communicate with a pressing surface of the plate itself through a series of holes. Facing the pressing surface of the plate 1 is a floating platen structure 2 having a corresponding series of holes 9 able to put into communication with the exterior two chambers 10, 11 in the floating platen structure fronting, each chamber being separated into two parts by a partition 12 which divides it into two distinct portions.

9 Claims, 6 Drawing Sheets

23
22
25
28
22
18
17
4
16
2

MACHINE FOR PRESSING OPEN SEAMS

BACKGROUND OF THE INVENTION

There are currently commercially available sewing machines, utilised in the sewing industry, which are able to sew various types of seam contemporaneously. When producing so-called "open" seams the two flaps extending beyond the stitch line or seam must be preliminarily separated, folded against the inner face of the fabric and conveniently stabilised in this position before proceeding to further sewing or tailoring of the article of clothing being made. Until now, however, notwithstanding several attempts, the combination of an effective surplus flap pressing phase with the sewing phase, has never successfully been achieved.

This difficulty is substantially attributable to the fact that in current pressing apparatus the necessary moistening of the flaps for pressing is effected upstream of the pressing plates and, moreover, in such a way that the fabric is not traversed by the pressing fluid so that it is difficult to achieve the desired effects.

OBJECTS OF THE INVENTION

The object of the present invention is that of eliminating the previously indicated disadvantages by providing a machine for folding and pressing the inner flaps of seams, in which the moistening operation takes place in correspondence with the pressing plates. Within the ambit of the above-stated object, a particular object of the present invention is that of providing a machine for folding and pressing the inner flaps of seams in which there is provided, beyond the moistening stage, a suction stage, a cold air blowing, and the possibility of mixing the various fluids.

Another object of the machine of the invention is to ensure that the fluids used during pressing, namely steam and cold air, actually pass right through the fabric being pressed.

Another object of the present invention is to provide a machine for folding and pressing the inner flaps of seams which is able to guarantee a perfect pressing of the flaps in the open position.

SUMMARY OF THE INVENTION

According to the present invention, there is provided a machine for folding and pressing open the inside flaps of seams, which can be fitted downstream of a sewing machine for making up textiles, characterised in that it comprises a heated plate in the body of which are formed separate chambers connected to a steam generator, a suction system and to a cold air blower respectively and communicating with the front of the plate itself through a series of holes facing which are a corresponding series of holes in the facing surface of a floating platen structure having two chambers each separated into two parts by a partition which divides it into two communicating portions, and two adjacent metal bands carried on pulleys having vertical axes extending between the heated plate and the said floating platen structure whereby to press the two inside flaps of the seam which have been preliminarily separated by means of an appropriate member, against the inner face of the portions of connected fabric.

Various other features and advantages of the present invention will become apparent from a study of the following descriptions of a preferred embodiment, in which reference is made to the accompanying drawings, provided purely by way of non-limitative example.

DESCRIPTION OF THE PREFERRED EMBODIMENT

Figure 1:
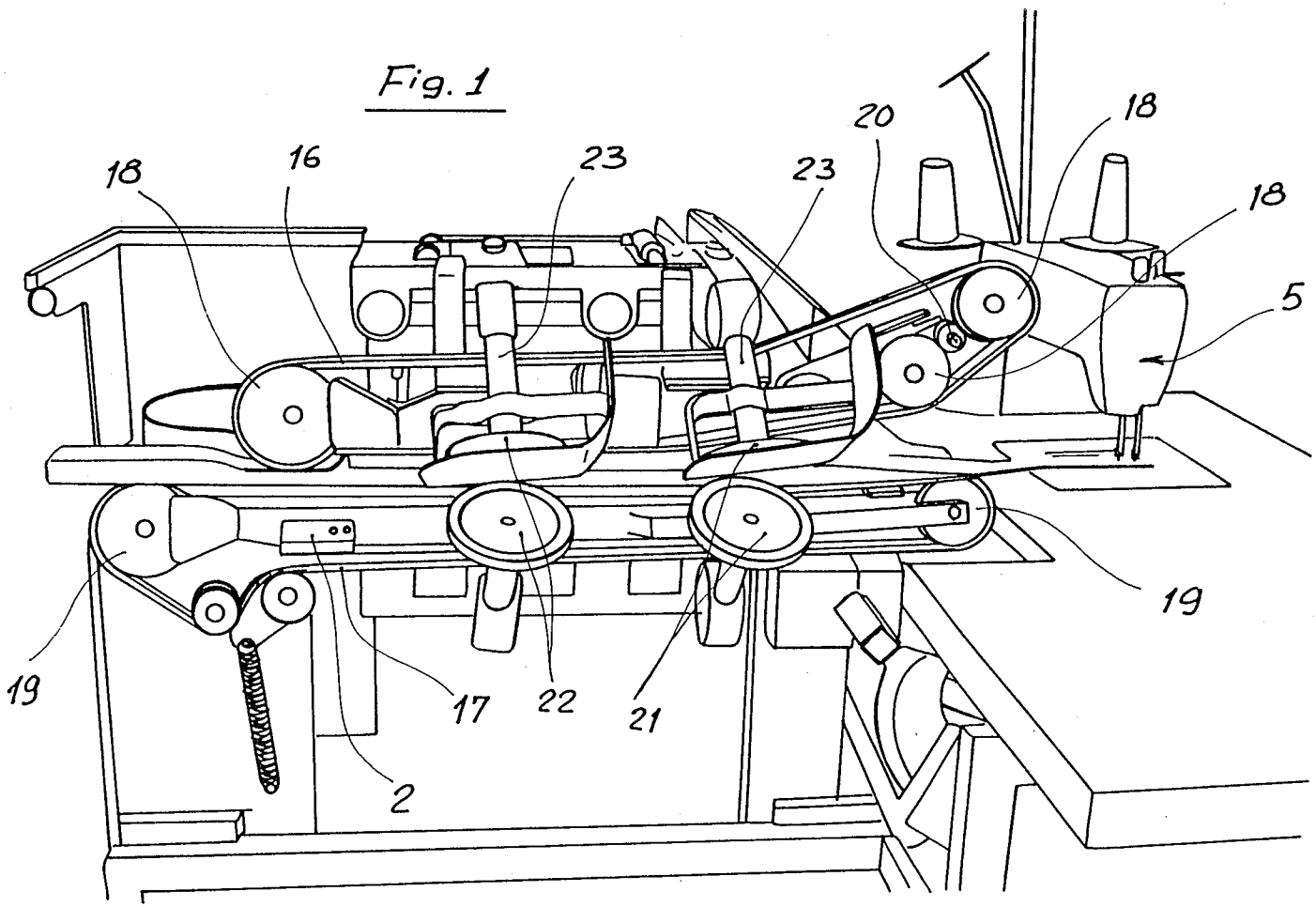
FIG. 1 is a schematic perspective view of a machine formed according to the principles of the present invention.
Figure 2:
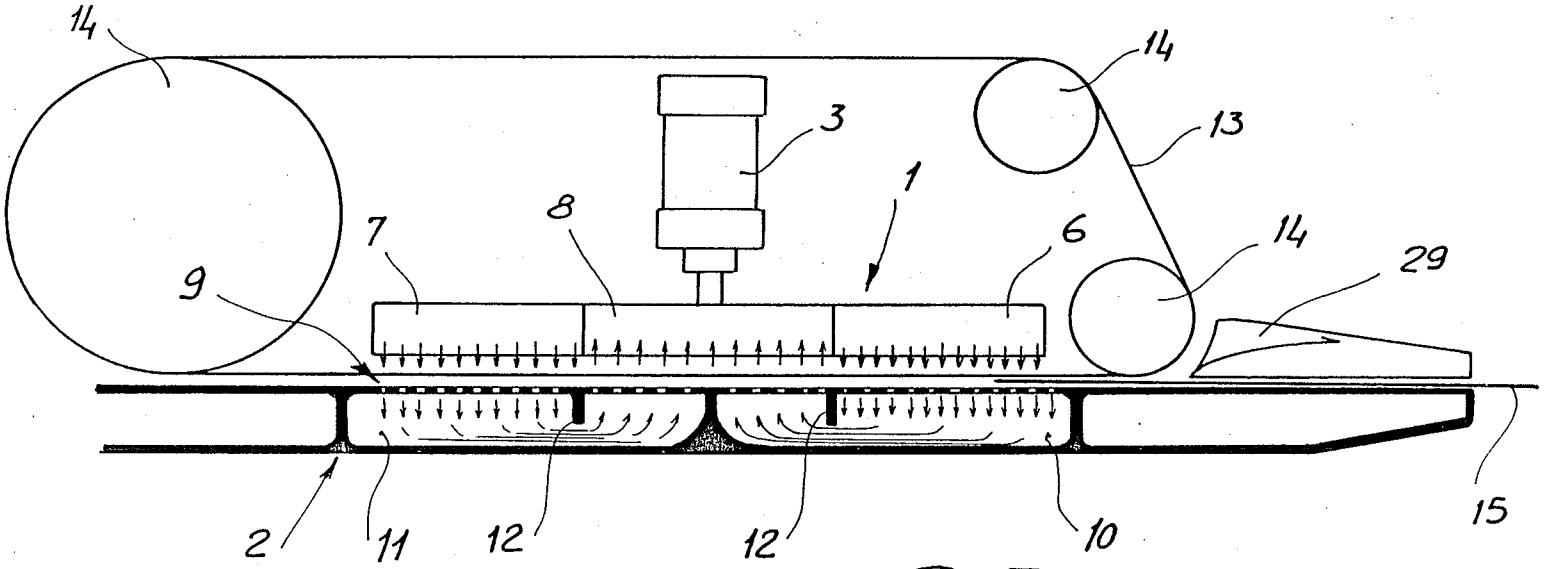
FIG. 2 is a schematic plan view from above of part of the flap pressing apparatus.
Figure 3:
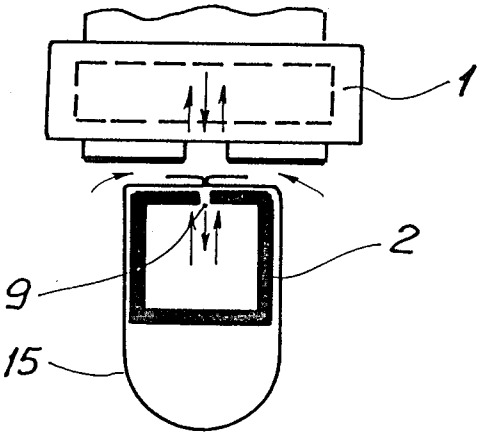
FIG. 3 is a schematic cross-section of the flap pressing apparatus.
Figure 4:
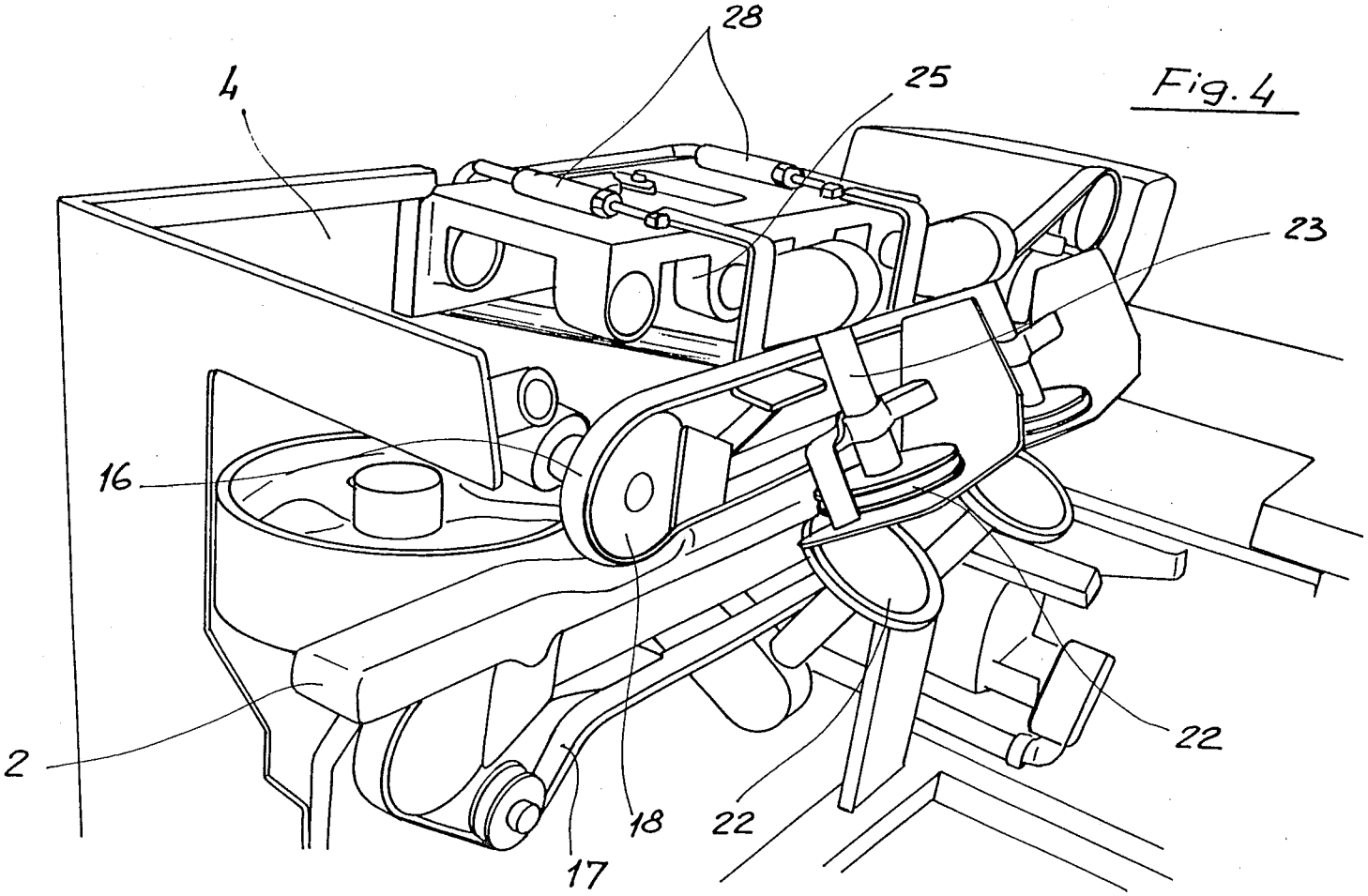
FIG. 4 is another schematic perspective view of the machine of the present invention, seen from a different angle.
Figure 5:
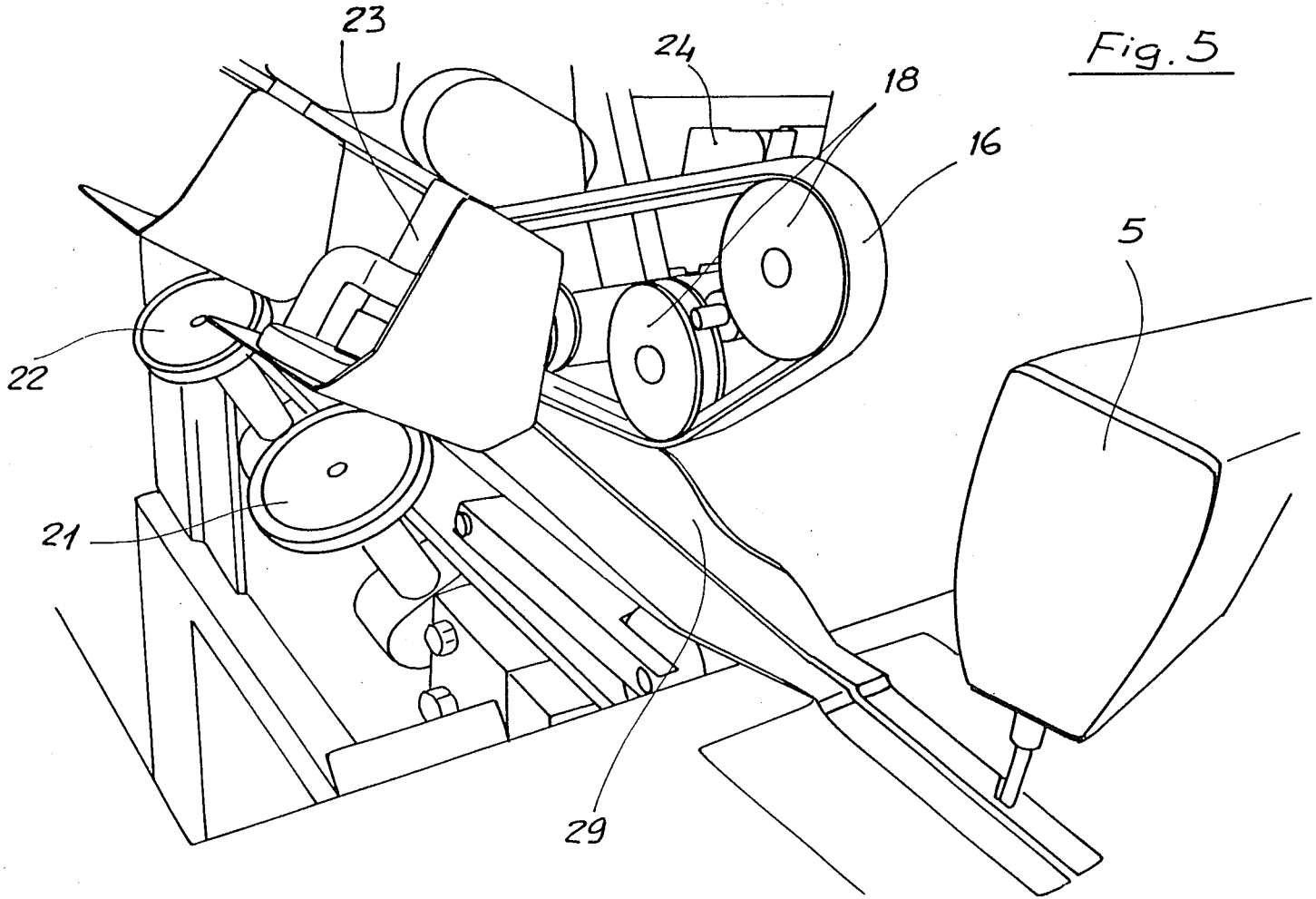
FIGS. 5 and 6 are further perspective views of part of the machine of the invention.
Figure 6:
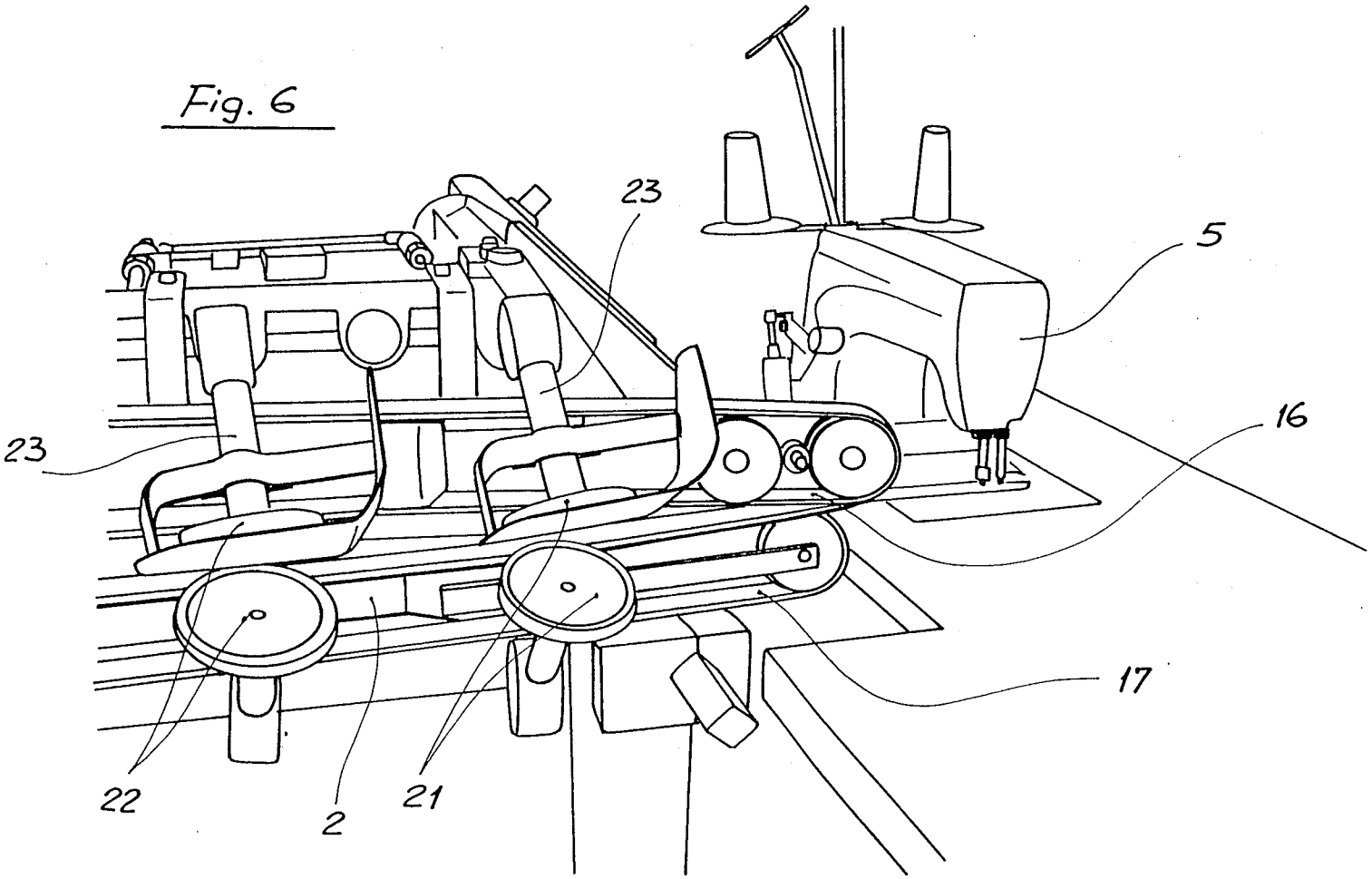
Figure 7:
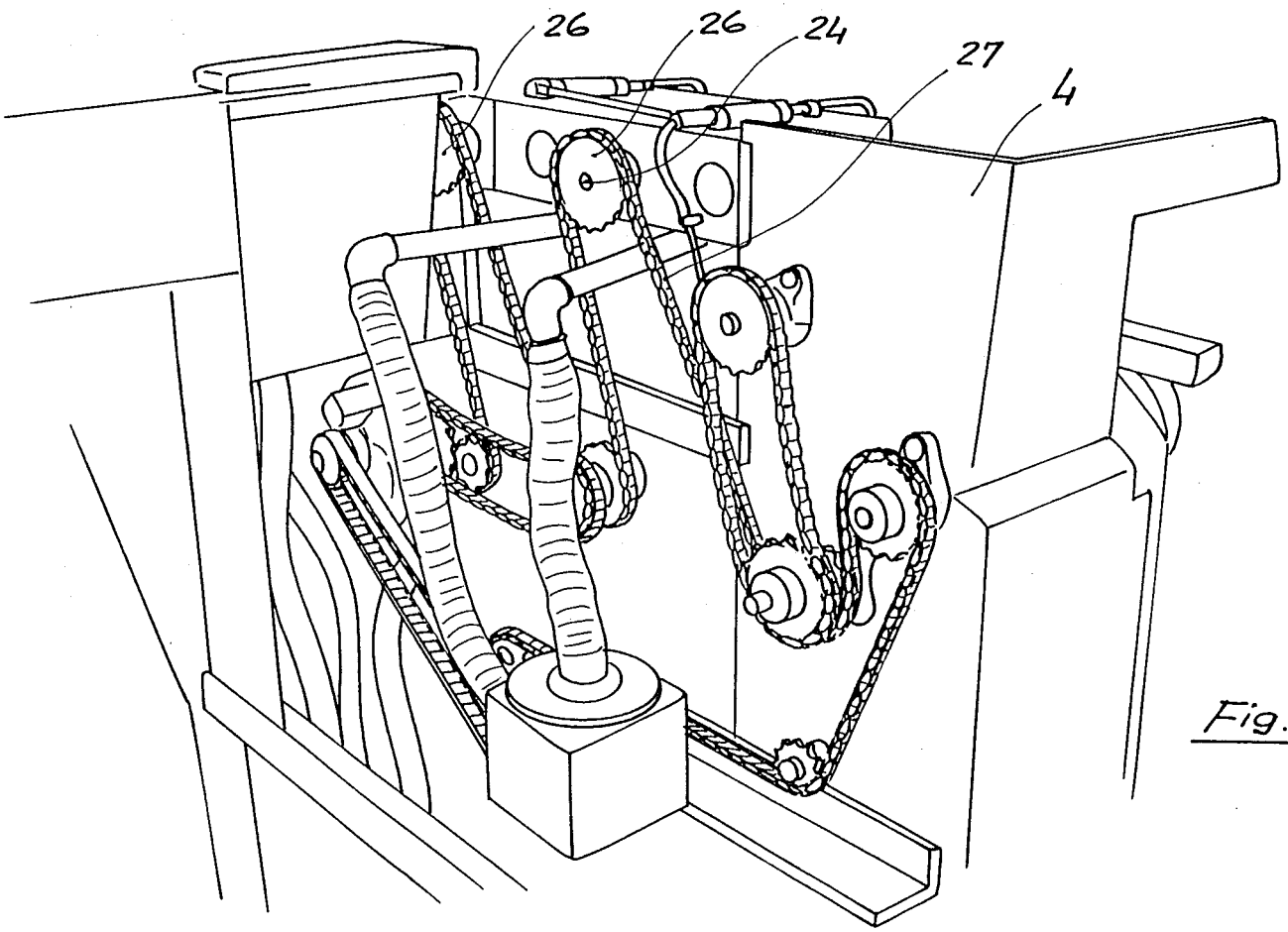
FIG. 7 is a perspective view from the rear of the machine of the invention.

The machine shown in the drawings is adapted for folding and pressing open the internal flaps of seams essentially comprises a heated pressing plate generally indicated 1 with which cooperates a platen structure 2 maintained in position, as will be specified better hereinbelow, by rotating locating members for which reason the said platen structure is referred to as a "floating" platen structure.

The said heated pressing plate 1 is rigidly connected, by means of a double acting cylinder 3 having a horizontal axis, to a suitable frame 4 arranged downstream of a sewing machine 5 able to effect different types of stitching contemporaneously and of a type known per se. The said heated pressing plate has a series of holes communicating with three chambers formed within its interior and disposed adjacent one another in a horizontal sense. Of these chambers, the two end ones 6 and 7 are supplied, respectively, with steam and with cold air, whilst the middle chamber 8 is connected to a suction system (not shown). The said floating platen structure is positioned facing the said series of holes and, in turn, has a corresponding series of holes 9 communicating with two internal chambers 10 and 11.

These latter are each partitioned into two parts by means of a semi-bulkhead 12 which divides it into two distinct parts; more precisely the outer portions of the two chambers face the portions of the heated plate 1 from which come blown steam and blown cold air respectively, whilst the inner or adjacent parts of the two chambers face the suction portion of the said pressing plate 1.

Between this heated pressing plate 1 and the floating platen structure 2, moreover, slide two metal bands 13 carried on vertical axis pulleys 14 and surface treated in such a way as to prevent an excessive wear and possible seizing phenomena. These two metal bands 13 are spaced from one another by a sufficient distance that, during sliding, they do not interfere with the series of holes formed in the plate 1 and in the floating platen structure 2.

The machine in question further comprises members 15 for the advancement of the sewn fabric, constituted by two belts 16 and 17, in siliconised fabric and coupled to silicone rubber sections capable of resisting high temperatures. These belts are carried on two series of pulleys, respectively 18 and 19, lying in the same vertical plane and having horizontal sections extending above and below the fabric to be supplied between the plate 1 and the floating platen structure 2.

It is appropriate to state that, of the pulleys which carry the upper belt 16, the two end ones closest to the sewing machine are pivotally mounted to a single arm 20 mounted on a horizontal axis spindle capable of partial rotation. In this way it is possible to vary the disposition of the terminal section of the belt itself with respect to the output plane of the fabric from the sewing machine.

Moreover, the pulleys which support the ends of the two belts opposite the said end are inserted into appropriate convex portions formed in corresponding positions on the said floating platen structure stabilising it in a longitudinal sense. The floating platen structure is maintained in contact with the heated plate 1 by the action of two pairs of wheels, respectively 21 and 22, which press on corresponding freely rotatable rollers suitably projecting through appropriate slots in the surface of the structure itself. Each of the said two pairs of wheels is mounted on an inclined rotating axis 23 and driven by means of bevel gears from a horizontal shaft 24 supported by appropriate bushes 25 to the end of which shaft is fixed a pinion 26 driven by a chain 27. These horizontal shafts, in particular, are able to describe an axial movement by the action of penumatic cylinders 28 which move appropriate brackets fixed on the shafts themselves.

At the end of the said floating platen structure 2, facing towards the sewing machine 5, there is positioned a separator member 29 operable to cause the opposite parts of the excess flaps of the seam made on the fabric 15 to open and fold back. In practice these flaps, after having been separated, are tightly engaged by the pair of metal bands 13 which draw them, with the aid of the pair of belts 16 and 17, between the heated plate 1 and the floating platen structure 2.

These flaps, maintained folded by the said metal bands, are subjected first to a steam treatment and subsequently are traversed, in correspondence with the portions adjacent the seam, by a flow of an air-steam mixture coming from the chamber 10 of the floating platen structure and sucked by the chamber 8 of the said plate 1. Subsequently, the said folded flaps are traversed by a flow of hot air coming from the longitudinally inner portion of the chamber 11 and also sucked by the chamber 8 mentioned above and, finally, by a flow of cold air coming from the chamber 7 adjacent this latter.

From what is explained above and from observation of the various Figures of the attached drawings the great functionality and practicality of use which characterises the machine for folding and pressing inner flaps of seams constituting the present invention are evident. In particular, the presence of the floating platen structure 2 makes it possible to press seams in fabric tubes, such as sleeves as well as pressing flaps of seams of fabric sewn open.

What is claimed is:

1. A machine for folding and pressing open the inside flaps of seams, adapted to be mounted downstream of a sewing machine for making up textile fabrics, said machine comprising:

a heated plate having a body with a front face and defining first, second and third chambers therein, means connecting said first chamber to a source of steam, means connecting said second chamber to a vacuum source, means connecting said third chamber to an air blower supplying cold air, and means defining a plurality of holes in said front face of said body of said heated plate, a floating platen structure having a front face positioned opposite and facing said front face of said heated plate, means defining a plurality of apertures in said front face of said floating platen structure, means defining two chambers in said floating platen structure each said chamber being separated into two parts by a partition which divides it into two distinct portions;

two adjacent metal bands carried on pulleys rotatable about respective vertical axes running between said heated plate and said floating platen structure whereby to press the two inside flaps of a seam, which have been preliminarily separated by means of an appropriate separating member, against the inner face of the adjacent portions of fabric joined by said seam.

2. The seam flap folding and pressing machine of claim 1, wherein said floating platen structure is maintained in position by rotating locating members and said heated plate is rigidly connected by means of a double acting cylinder with a horizontal axis to a frame arranged downstream of a sewing machine.

3. The seam flap folding and pressing machine of claim 1, wherein said first, second and third chambers of said heated plate are adjacently located in a horizontal row with said first and third chambers at opposite ends of the row being supplied, respectively, with steam and with cold air, whilst said second chamber is connected to said vacuum system.

4. The seam flap folding and pressing machine of claim 1, wherein said floating platen structure is positioned opposite said holes in said heated plate and is provided with a corresponding series of holes communicating with said two internal chambers which are separated by means of said respective partition walls into two distinct portions, and wherein the outer portions of said two internal chambers face said heated plate in register with said first and third chambers thereof from which steam and hot air are blown respectively, whilst the inner portions of said two chambers in said floating platen structure face said second chamber of said plate.

5. The seam flap folding and pressing machine of claim 1, wherein said metal bands between said heated plate and said floating platen structure are carried on pulleys having vertical axes, said bands being surface treated in such a way as to prevent an excessive wear and possible seizure phenomena; said two metal bands further being spaced from one another by such a distance that during running they do not interfere with said plurality of holes formed in said pressing plate or in said floating platen structure.

6. The seam flap folding and pressing machine of claim 1, wherein there are means for causing advancement of the sewn fabric, said means being constituted by two belts made of siliconised fabric and joined to silicone rubber sections capable of resisting high temperatures, said belts being carried by two series of pulleys lying in the same vertical plane and having horizontal passes extending above and below the fabric to be supplied between said pressing plates and said floating platen.

7. The seam flap folding and pressing machine of claim 6, wherein said pulleys which carry said upper belt include a pair of pulleys at the end closest to the sewing machine which are rotatable at the end of a pivoted arm mounted at the other end on a shaft having a horizontal axis allowing it to turn to bring the said pulleys towards or away from the cooperating belt, and at least one pulley at the opposite end which extends into an appropriate convexly curved portion formed in said floating platen structure thereby stabilising it in a longitudinal sense.

8. The seam flap folding and pressing machine of claim 1, wherein said floating platen structure is maintained in contact with said heated pressing plate by the action of two pairs of wheels which press on corresponding freely rotatable rollers projecting through slots in the surfaces of said floating platen structure, each of said two pairs of wheels being mounted on an inclined shaft driven, via a bevel gear, by a horizontal shaft to the end of which is fixed a pinion driven by a chain.

9. The seam flap folding and pressing machine of claim 8, wherein said horizontal shafts can perform an axial movement under the action of respective pneumatic cylinders which move appropriate brackets fixed to the shafts.

* * * * *